US011058601B2

(12) United States Patent
Gloyd

(10) Patent No.: US 11,058,601 B2
(45) Date of Patent: Jul. 13, 2021

(54) TARGETED VIBRATION THERAPY SYSTEMS AND METHODS

(71) Applicant: Matthew Christopher Gloyd, Phoenix, AZ (US)

(72) Inventor: Matthew Christopher Gloyd, Phoenix, AZ (US)

(73) Assignee: Vibration Release Techniques LLC, Scottsdale, AZ (US)

( * ) Notice: Subject to any disclaimer, the term of this patent is extended or adjusted under 35 U.S.C. 154(b) by 176 days.

(21) Appl. No.: 16/436,883

(22) Filed: Jun. 10, 2019

(65) Prior Publication Data

US 2020/0383868 A1 Dec. 10, 2020

(51) Int. Cl.

| | |
|---|---|
| ***A61H 23/00*** | (2006.01) |
| ***A63B 1/00*** | (2006.01) |
| ***A63B 21/00*** | (2006.01) |
| ***A63B 23/00*** | (2006.01) |

(52) U.S. Cl.

CPC ..... *A61H 23/00* (2013.01); *A63B 1/00* (2013.01); *A63B 21/00185* (2013.01); *A63B 21/154* (2013.01); *A63B 23/00* (2013.01); *A61H 2201/0153* (2013.01); *A63B 2023/006* (2013.01); *A63B 2213/00* (2013.01)

(58) Field of Classification Search

CPC .. A63B 21/00196; A63B 21/002–0023; A63B 2023/006; A63B 1/00; A63B 21/154; A63B 23/00; A63B 21/00185; A63B 2213/00; A61H 23/00; A61H 2201/0153; A61H 1/00; A61H 39/007; A61H 39/004

See application file for complete search history.

(56) References Cited

U.S. PATENT DOCUMENTS

| | | | | |
|---|---|---|---|---|
| 5,501,657 | A * | 3/1996 | Feero | A61H 7/00 128/898 |
| 5,609,566 | A | 3/1997 | Pupovic | |
| 5,971,901 | A * | 10/1999 | Shaw | A61H 1/0218 482/142 |
| 10,314,759 | B1 * | 6/2019 | Ramage | A61H 1/006 |
| 2004/0005972 | A1 * | 1/2004 | Sugiyama | A61H 9/0078 482/148 |
| 2004/0116838 | A1 * | 6/2004 | Polvi | A61H 7/00 601/1 |
| 2008/0070210 | A1 | 3/2008 | Hitzmann | |

(Continued)

FOREIGN PATENT DOCUMENTS

| | | | |
|---|---|---|---|
| CA | 2533978 | C | 3/2005 |

*Primary Examiner* — Nyca T Nguyen
(74) *Attorney, Agent, or Firm* — Lynch LLP

(57) ABSTRACT

This application discloses systems and methods of applying vibration to a targeted area on an individual that is experiencing pain, discomfort, or other musculoskeletal symptoms. Steps of the method include lengthening followed by oscillation and vibration. The lengthening step requires positioning the individual (e.g., with the help of a stretching cage) such that the individual experiences a stretching sensation in a targeted area (e.g., a group of muscles, ligaments, tendons, etc.). Next, the individual oscillates in and out of that lengthened position while vibration is applied to the targeted area. It has been discovered that these techniques can bring about dramatic and quick improvements in flexibility and range of motion, while also diminishing symptoms like pain and discomfort.

7 Claims, 10 Drawing Sheets

(56) References Cited

U.S. PATENT DOCUMENTS

| | | | | |
|---|---|---|---|---|
| 2009/0054816 | A1* | 2/2009 | Zake | A61H 7/001 601/135 |
| 2009/0176635 | A1* | 7/2009 | Brinson | A61H 7/001 482/141 |
| 2009/0198159 | A1* | 8/2009 | Linzell | A61H 7/003 601/138 |
| 2009/0221943 | A1* | 9/2009 | Burbank | A61N 1/36021 601/46 |
| 2009/0270228 | A1* | 10/2009 | Hoile | A63B 21/00196 482/9 |
| 2010/0113992 | A1* | 5/2010 | Godfrey | A61H 15/0078 601/70 |
| 2010/0234774 | A1* | 9/2010 | Cheremsky | A61H 23/02 601/23 |
| 2011/0040235 | A1* | 2/2011 | Castel | A61M 37/00 604/20 |
| 2011/0046523 | A1 | 2/2011 | Altshuler | |
| 2011/0098781 | A1* | 4/2011 | Mantle | A61H 1/008 607/46 |
| 2013/0178768 | A1* | 7/2013 | Dalebout | A61H 15/0092 601/46 |
| 2014/0213421 | A1* | 7/2014 | Paris | A63B 21/0603 482/105 |
| 2018/0161192 | A1* | 6/2018 | Sudell | A61F 5/048 |
| 2019/0099327 | A1* | 4/2019 | Cooper | A61H 39/04 |

* cited by examiner

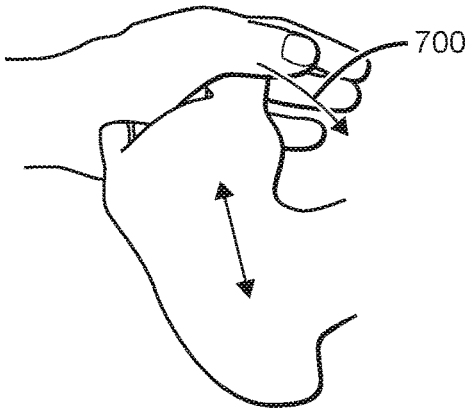
FIG. 7
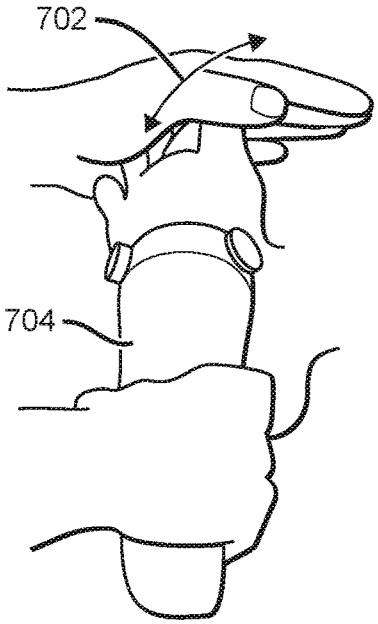
FIG. 8
FIG. 9
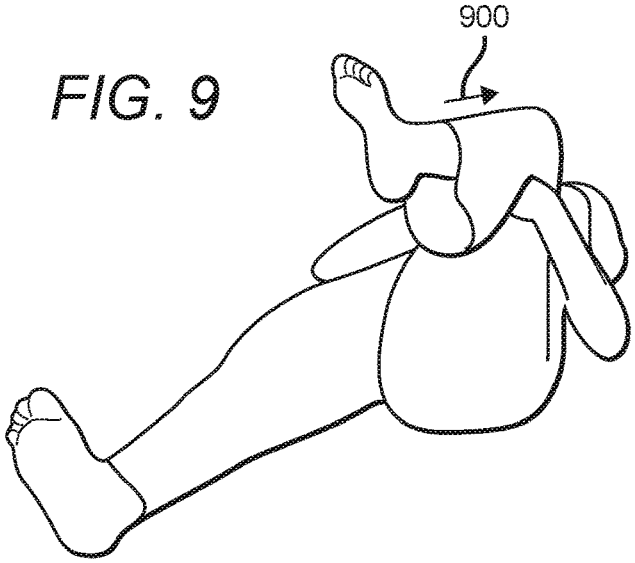
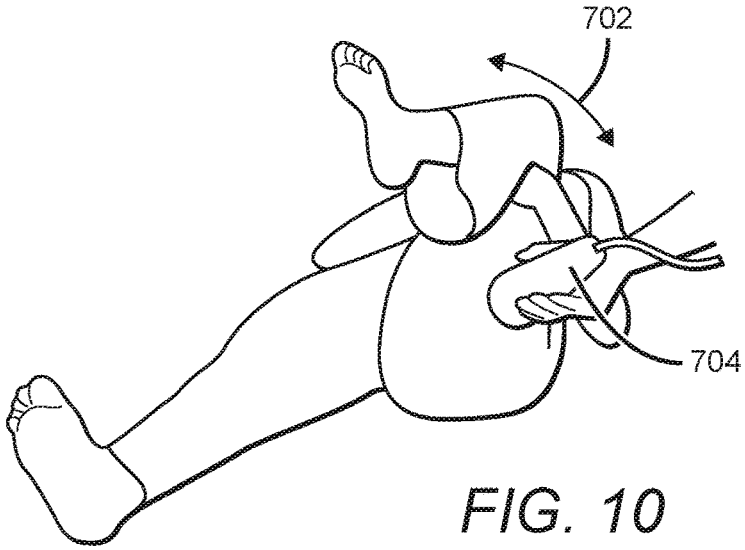
FIG. 10

FIG. 11
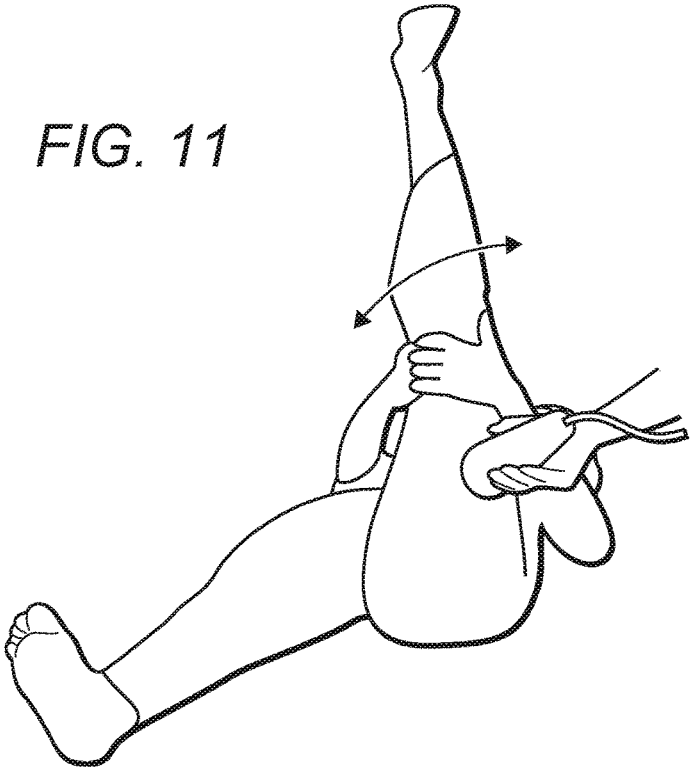
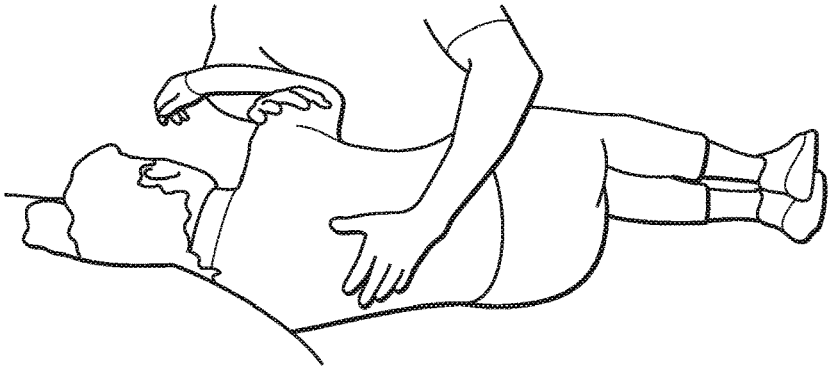
FIG. 12
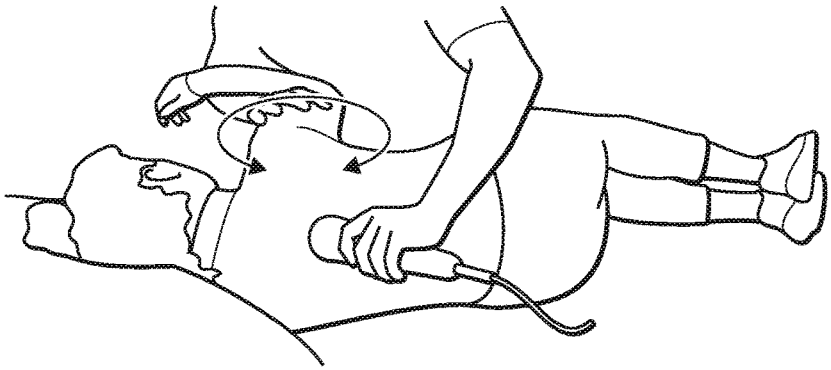
FIG. 13

FIG. 27
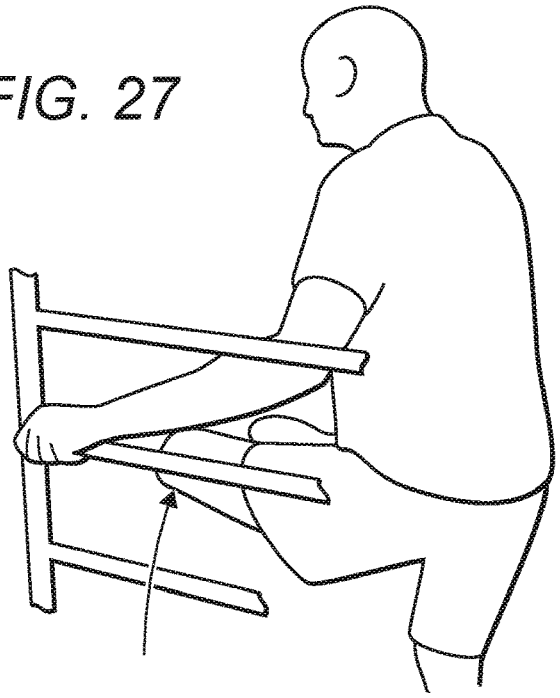
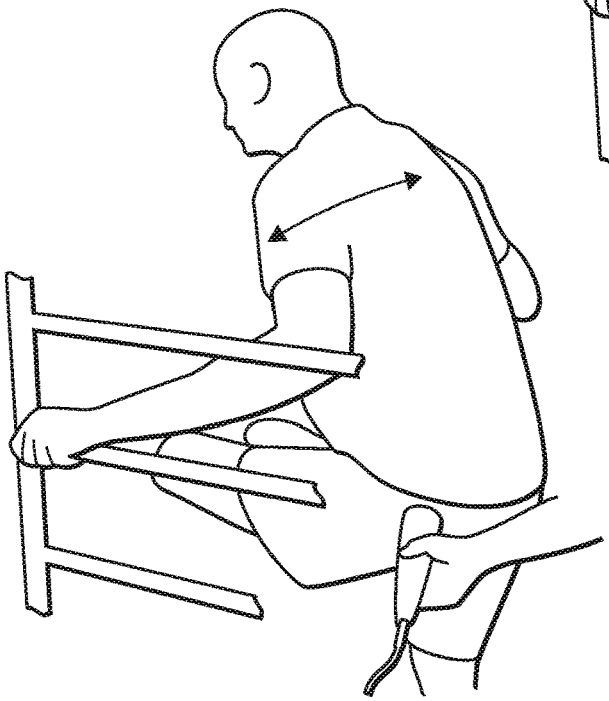
FIG. 28
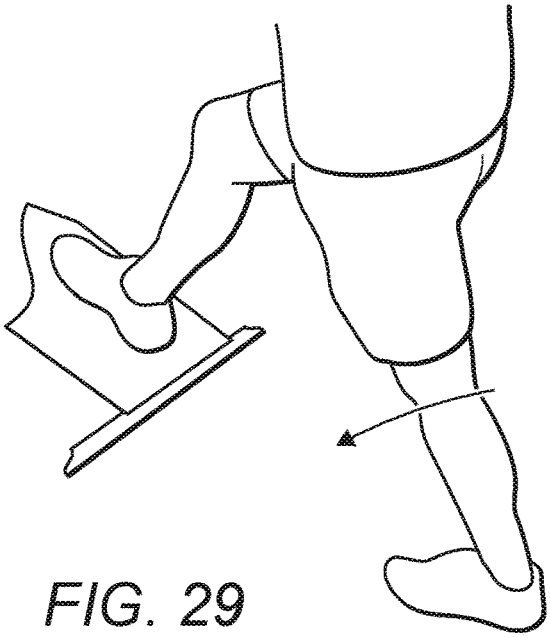
FIG. 29

FIG. 30
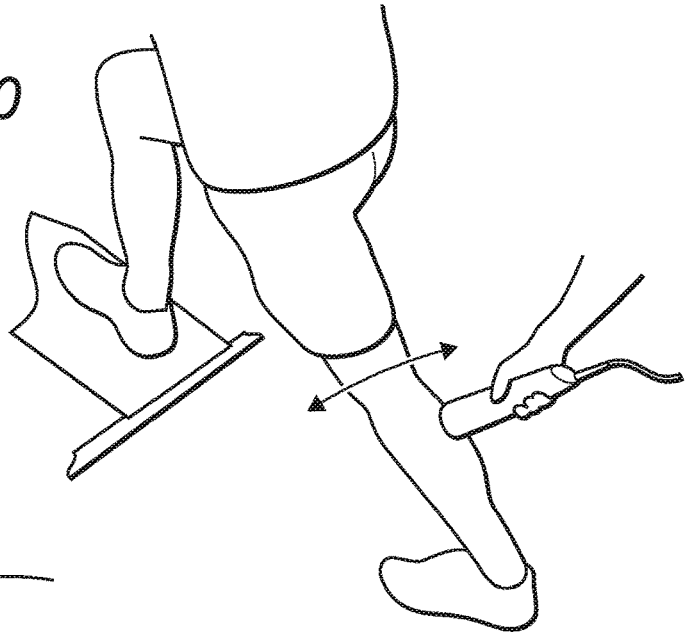
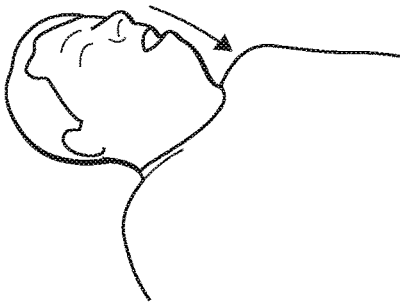
FIG. 31
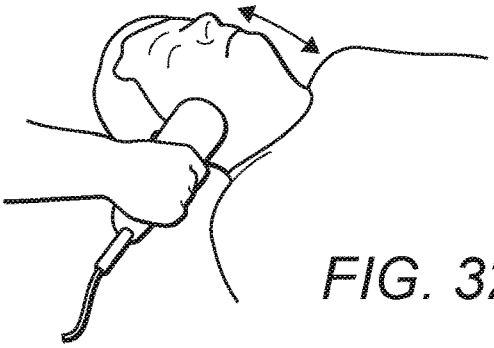
FIG. 32
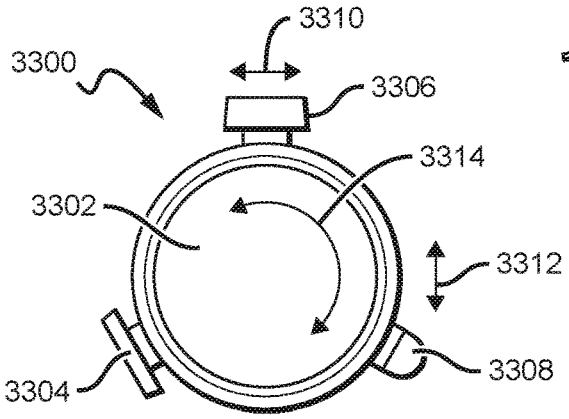
FIG. 33B
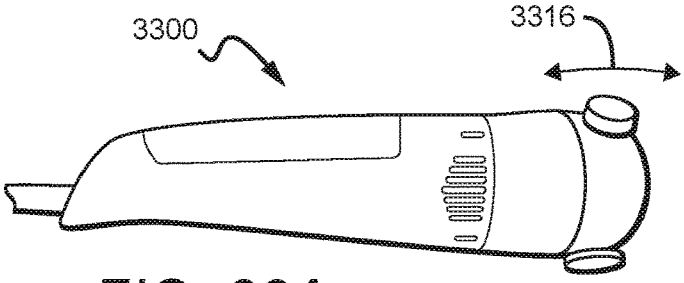
FIG. 33A

TARGETED VIBRATION THERAPY SYSTEMS AND METHODS

FIELD OF THE INVENTION

The field of the invention is physical therapy.

BACKGROUND

The background description includes information that may be useful in understanding the present invention. It is not an admission that any of the information provided in this application is prior art or relevant to the presently claimed invention, or that any publication specifically or implicitly referenced is prior art.

Physical therapy techniques are constantly evolving as we discover new, better methods of treating various injuries, pains, tightness, etc. Targeted vibration has been incorporated into some therapies, but its full potential has yet to be realized. For example, Canadian Patent No. 2,533,978 to Hoffman discusses the use of targeted vibrations that is "for use in remediation of blood flow disturbances." This fails to appreciate how targeted vibration techniques can be used to address, e.g., pain and muscle tightness.

U.S. Pat. No. 5,609,566 to Pupovic, on the other hand, describes a machine that is used to improve symptoms in patients complaining of back pain. Although the '566 Patent does refer to the use of a "vibromasseur device to generate vibrations," it elaborates that the device "is fitted to the arched tube in the zone of the patient's back." The purpose of the vibrations described in this patent are to relax a user's muscles to help them relax. This patent fails to consider how targeted vibration methods can be applied to improve a variety of symptoms.

Thus, there is still a need in the art for improved methods and techniques of applying targeted vibration to improve a wide variety of symptoms that targeted vibration has never been used to address before.

These and all other extrinsic materials discussed in this application are incorporated by reference in their entirety. Where a definition or use of a term in an incorporated reference is inconsistent or contrary to the definition of that term provided in this application, the definition of that term provided in this application applies and the definition of that term in the reference does not apply.

SUMMARY OF THE INVENTION

The present invention provides apparatuses, systems, and methods of applying targeted vibration in association with different devices to improve musculoskeletal symptoms.

In one aspect of the inventive subject matter, a method of improving symptoms in an individual's body is contemplated. The method includes the steps of: lengthening a targeted area of an individual until the individual is in a lengthened position, where the targeted area includes at least one muscle and wherein the lengthened position is one in which the individual experiences a stretching sensation in the targeted area; manipulating the individual, in an oscillatory manner, in and out of the lengthened position; and while manipulating the individual, applying vibration (e.g., at a frequency of between 100 Hz and 300 Hz at an amplitude of 0.5-7 mm in rounds lasting between 10 and 45 seconds) to the targeted area using a handheld vibration tool.

In some embodiments, the step of lengthening further comprises the individual using a stretching cage to facilitate lengthening the targeted area. The stretching cage can further include a pulley that is affixed to the stretching cage so individual can use the pulley to facilitate lengthening of the targeted area.

In some embodiments, the step of manipulating the individual in and out of the lengthened position involves oscillating in and out of the lengthened position 10-30 times. Steps of this method can be applied as many times as necessary to bring about improvement in the individual's symptoms (e.g., 1-6 times), though there is no limit to how many rounds of treatment an individual can undergo.

One should appreciate that the disclosed subject matter provides many advantageous technical effects including methods that quickly and effectively improve a wide variety of musculoskeletal symptoms.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 7 shows the bottom of an individual's foot being lengthened.

FIG. 8 shows the bottom of an individual's foot being oscillated while vibration is applied.

FIG. 9 shows an individual lengthening the gluteal muscles.

FIG. 10 shows an individual oscillating the gluteal muscles while vibration is applied.

FIG. 11 shows an alternative stretch to lengthen the gluteal muscles.

FIG. 12 shows an individual on their side, lying down, with their knees and hips flexed to 90 degrees to treat symptoms in the individual's back and shoulders.

FIG. 13 shows an individual on their side, lying down, with their knees and hips flexed to 90 degrees while vibration is applied to their back and shoulder during oscillation.

FIG. 27 shows an individual lengthening the gluteal muscles in a stretching cage.

FIG. 28 shows an individual oscillating the gluteal muscles in a stretching cage while vibration is applied.

FIG. 29 shows an individual performing a standing gastrocnemius/soleus stretch in a stretching cage.

FIG. 30 shows an individual oscillating a standing gastrocnemius/soleus stretch in a stretching cage while vibration is applied.

FIG. 31 shows an individual opening the jaw to stretch the jaw muscles in association with treating temporomandibular joint dysfunction.

FIG. 32 shows an individual opening and closing their jaw while vibration is applied to treat temporomandibular joint dysfunction.

FIG. 33A shows a head-on view of a vibration tool of the inventive subject matter.

FIG. 33B shows a side view of a vibration tool of the inventive subject matter.

DETAILED DESCRIPTION

Figure 1:
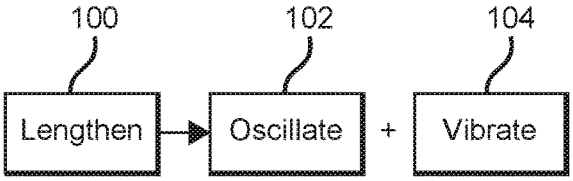
FIG. 1 is a flowchart showing how embodiments of the inventive subject matter are applied, generally.

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed considering the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

The inventive subject matter is directed to methods of improving, among other things, muscle flexibility and joint range of motion by incorporating into treatment a vibrating mechanism and, in some embodiments, stretching devices (e.g., a stretching cage or portion thereof).

To lengthen an individual's muscle(s) in a fraction of the time it would take for other techniques to bring about the same result, several steps are undertaken in association with one or more devices that help to optimize results. Along with a vibrating tool, it has been discovered that implementing stretching apparatuses and systems (e.g., stretching cages, pulleys, etc.) can improve outcomes. Embodiments of the inventive subject matter increase range of motion in individuals' joints that would otherwise be restricted and can also be used to alleviate pain in, e.g., muscles and joints. By applying the method to muscles, tendons, and ligaments surrounding joints, joints are given more freedom of movement and shear and/or compression forces on nearby joint surfaces are relieved. Embodiments of the inventive subject matter have been shown to reduce pain and optimize flexibility in a matter of seconds.

Different muscle groups can be treated in a variety of ways, but the underlying principle behind each different therapy remains the same. An individual stretches a targeted muscle or muscle group (e.g., with the help of a stretching cage) while a vibrating tool is used to apply targeted vibration to that muscle or muscle group. The three main steps involve lengthening, oscillating, and vibrating a region on an individual's body. Each of these steps will be discussed in more detail below. Embodiments of the inventive subject matter can quickly and effectively improve muscle length, improve range of motion, and treat pain.

FIG. 1 is a flowchart showing generally the steps involved with methods of the inventive subject matter. Step 100 involves lengthening. Lengthening can be applied to a targeted area on an individual's body, e.g., one or any combination of a muscle, a group of muscles, a joint, a tendon, a ligament, scar tissue, or any other part of the body that undergoes movement and can experience pain or tightness.

Step 102 involves oscillating and is done in conjunction with step 104, which involves the application of vibration. Oscillation involves a repeated tensioning and relaxing of a targeted area (e.g., tensioning beyond the lengthened position and relaxing past the lengthened position), and the application of vibration involves using a tool to apply vibration to the targeted area at desired frequencies and intensities. After going through these steps one or more times, it has been discovered that the individual's targeted area becomes looser, more relaxed, and individuals have reported an alleviation of pain and other symptoms associated with tightness in the targeted area. Each of the three steps outlined above will be discussed in more detail below.

In the lengthening step, an individual is asked to lengthen a targeted area until they begin to experience a stretching sensation. The targeted area is one identified as being associated with an individual's symptoms—be that inflexibility, pain, or otherwise. Thus, by applying steps of the inventive subject matter to a targeted area, an individual can experience alleviated symptoms, improved flexibility, etc. The targeted area may not always be the same area where the individual experiences symptoms. For example, when an individual has shin splints, it can sometimes be caused by an overall tightening in the individuals hamstrings, lower back, or both. In such a situation, the targeted areas can be the individual's hamstrings and lower back, and methods of the inventive subject matter can be applied to both targeted areas. The step of lengthening can be undertaken in association with, e.g., a stretching cage (shown in FIG. 2).

Figure 2:
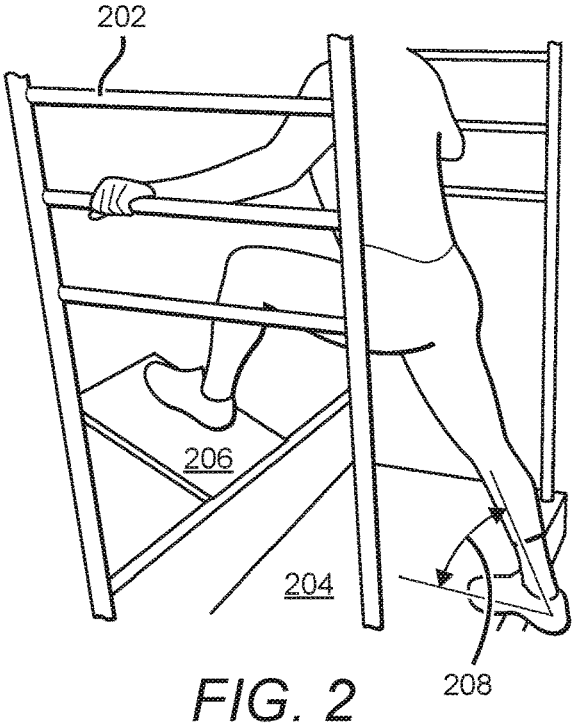
FIG. 2 shows an individual lengthening their calf muscles in a stretching cage.

The first task of lengthening involves determining how far to lengthen a targeted area. The individual's targeted area is lengthened to determine a base-line flexibility. For example, as shown in FIG. 2, an individual stretching their calf could use a stretching cage 202 to lengthen that muscle group until that individual experiences a stretching sensation in their calf muscles. The individual places their foot on a sloped surface 204 of the stretching cage 202 to, e.g., reduce discomfort in holding a lengthened position. The sloped surface 204, as shown in FIG. 2, can be angled to hold the individual's ankle at off-neutral angles to bring about more targeted stretching. The individual's front foot can optionally rest on a raised surface 206 to further facilitate muscle lengthening, as shown in FIG. 2.

Stretching cages can give individuals a dedicated, self-contained stretching area with a safe platform for comprehensive stretching to increase flexibility. Stretching cages eliminate the need for floor-based stretching or leaning uncomfortably over other equipment, which is desirable in embodiments of the inventive subject matter in which individuals lengthen a targeted area before oscillating that targeted area while vibration is applied. Ensuring ease of lengthening and oscillation can improve outcomes, especially in individuals that may find it more difficult to lengthen a targeted area without losing balance (e.g., the elderly, or individuals experiencing symptoms that affect their balance or proprioception). Moreover, stretching cages can facilitate stretches for any targeted area on an individual's body (e.g., and muscle or muscle group), including targeted areas that are difficult to lengthen without assistance. The easier it is for an individual to lengthen (and subsequently oscillate) a target area, the easier it is for that individual to have methods of the inventive subject matter applied properly, thereby yielding better results.

Figure 4:
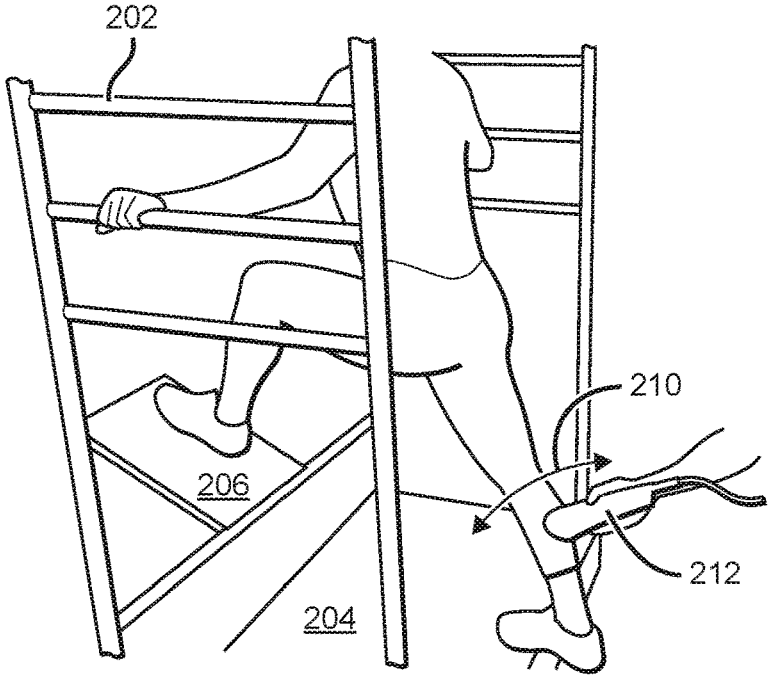
FIG. 4 shows an individual oscillating their calf muscles in a stretching cage while vibration is applied.

When an individual's a targeted area has been lengthened until the individual feels a stretching sensation, the position that the individual is in is used to determine a flexibility baseline. In some embodiments, the flexibility baseline can be measured as shown by angle 208 in FIG. 2. Although angle 208 shows an angle between the individual's foot and shin, it is contemplated that the angle can be measured between the individual's shin when perpendicular to the individual's foot and the individual's shin when the individual's calf muscles are lengthened (e.g., 90 degrees minus angle 208). A flexibility baseline can be measured in a variety of different ways, and, in any event, a flexibility baseline must be measured in the same way that a new measurement is taken after the individual undergoes the oscillating and vibrating steps. Consistent measurement ensures accurate improvement measurements. For example, if angle 208 is measured to be 45 degrees before oscillation and vibration are applied to the calf muscles as shown in FIG. 4, then after oscillation and vibration, angle 208 is remeasured and compared to the previous measurement. If the remeasurement shows the new angle to be 35 degrees, then the individual will have experienced a 22.2% improvement (e.g., $(1-35/45)\times100=22.2\%$).

Once an individual's targeted area is lengthened, the steps of oscillating and vibrating can be undertaken. These steps are undertaken simultaneously. It has been discovered that the act of applying vibration to a targeted area that is lengthened prior to oscillating about that lengthened position can give rise to dramatic improvements in flexibility and it can alleviate pain in the targeted area or in surrounding areas affected by the targeted area (e.g., loosening hamstrings can alleviate shin pain, etc.).

Figure 3:
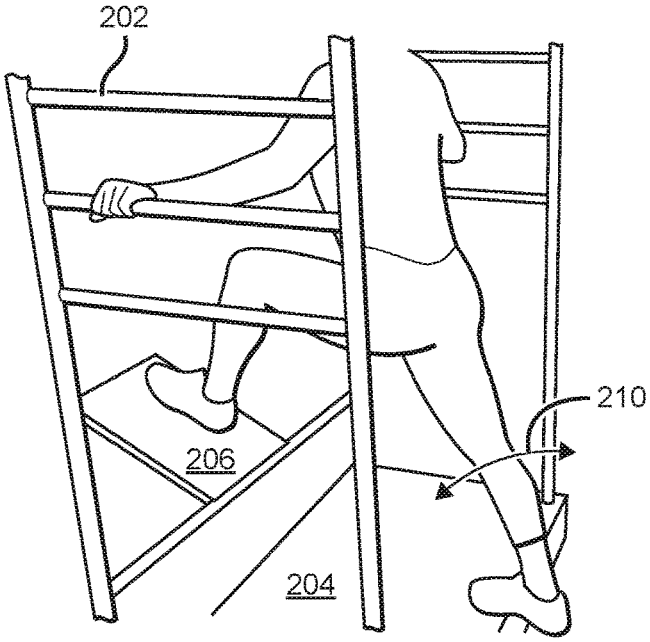
FIG. 3 shows an individual oscillating their calf muscles in a stretching cage.

Oscillation is shown in FIG. 3 by line 210. Line 210 has arrows on either end to show the movement that the individual undergoes to oscillate the targeted area, in this case, the calf muscles. Thus, after lengthening the calf muscles with the assistance of a stretching cage 202, the individual leans into and out of the stretch to induce, among other things, a neurodynamic flossing effect that can help improve outcomes when vibration is applied.

As discussed above, an individual's targeted area is first lengthened until the individual feels a "stretching" sensation in the targeted area. Once the individual begins to experience a stretching sensation, they then lean into and out of the stretch in an oscillatory manner (e.g., pivoting into and out of the stretch about the ankle joint as shown by line 210 in FIG. 3). While oscillating in and out of the stretch, targeted vibration is then applied to the targeted area as shown in FIG. 4. FIG. 4 shows the individual oscillating according to line 210 with a handheld vibrating tool 212 being used to apply vibration to the targeted area (in the case of FIG. 4, the individual's calf muscles).

In some embodiments, additional devices can be used to facilitate or improve either or both steps of lengthening and oscillating. For example, an active assist device such as a pulley, dowel, band, strap, etc., can be used to facilitate oscillation in different targeted areas that can otherwise be difficult to lengthen and subsequently oscillate, especially when an individual has issues with mobility or movement brought on by, e.g., old age, pain, disease, injury, or any other condition that can affect mobility or movement.

While the individual oscillates in and out of a lengthened position, targeted vibration is applied by a handheld vibrating tool 212. Over the course of applying the vibration while oscillating in and out of a stretch, is has been discovered that the individual will experience a diminishing of the stretching sensation in the targeted area. In other words, although an individual may have experienced a stretching sensation at a first angle 210, as vibration is applied, in the course of applying vibration while the individual oscillates, the stretching sensation will diminish at that same angle 210, indicating an increase in flexibility.

Oscillation and vibration are applied in rounds. In one round, an individual oscillates some number of times while vibration is applied to the targeted area. It is contemplated that, between rounds, the lengthened position can be re-set to account for flexibility gains experienced in each round of oscillation and vibration. Rounds of the process are repeated to lengthen the targeted area until, e.g., the targeted area no longer continues to elongate or until enough gains in flexibility, pain reduction, etc. have been experienced by the individual. It is contemplated that practitioners (e.g., physical therapists) can apply a varying number of rounds (e.g., 1-10 or more, depending on a rate of improvement) of oscillations (e.g., 10-40, or a different number depending on, for example, rate of improvement) and vibration to achieve desired improvements. A round of oscillation and vibration can go on for some amount of time, e.g., from 5 seconds-5 minutes or any subset of ranges within those values. The amount of time, number of oscillations, and vibration characteristics can all be adjusted based on, e.g., an individual's age, rate of improvement, symptoms, the targeted area, etc.

The number of rounds of oscillation and vibration needed to bring about a desired improvement can vary depending on a wide variety of factors including the individual's age, the cause of the individual's symptoms, rate of improvement, symptoms, the targeted area, etc. For example, the number of rounds can vary from 1-6 (or more, if needed) and the amount of time spent per round can vary from 10-60, from 60-120 seconds, and so on as described above. It has been discovered that, for many individuals, improvements can be experienced after the application of 4 rounds of oscillation and vibration, where each round lasts approximately 30 seconds. As with many physical therapy treatments, continued treatment over the course of weeks and months is often advisable.

As mentioned above, as flexibility in a targeted area can increase during the course of applying vibration, the individual can be repositioned so that the targeted area is reset to a new lengthened state (e.g., setting a new baseline flexibility) whereby the individual again feels the "stretching" sensation. Re-setting of the lengthened position can occur after each round of vibration and oscillation is applied, but in some embodiments, it can be done after several rounds (e.g., 1-4 or 4-8) before completing additional rounds.

Vibration can be applied by using a handheld vibrating tool, as shown in FIG. 4. Vibration can be applied at frequencies between 100-300 Hz (and more preferably 150-250 Hz) combined with amplitudes between 0.5-7 mm (and more preferably 1-4 mm), where vibration amplitude is measured as a difference in position between crest and trough in a vibration cycle that are experienced by the vibrating mechanism of the handheld vibration tool. For example, if the vibrating mechanism moves along a single dimension, e.g., a straight line of movement between point A to point B, where the vibrating mechanism would otherwise be at rest at point C which is in between points A and B, then the amplitude measurement is taken as a distance between points A and B. The handheld vibration tool is contemplated as being able to apply vibration in a concentrated area (e.g., using a vibrating mechanism located on one end of the handheld vibrating tool). Vibration from the handheld vibrating tool can be applied as one or any combination of an in-and-out movement, a side-to-side movement, and a circular movement.

In embodiments where vibrations are applied to an individual's joint and, e.g., the muscles, tendons, and ligaments around a joint, it has been discovered that lengthening, oscillating, and vibrating an individual's targeted area can, as a result, cause an individual to experience an elimination or breaking apart of fibrotic tissues and reduced calcification. Fibrotic tissue and calcification are both known to cause discomfort and to restrict range of motion, and addressing these issues helps individuals return to normal levels of activity with reduced pain and increased range of motion.

Figure 5:
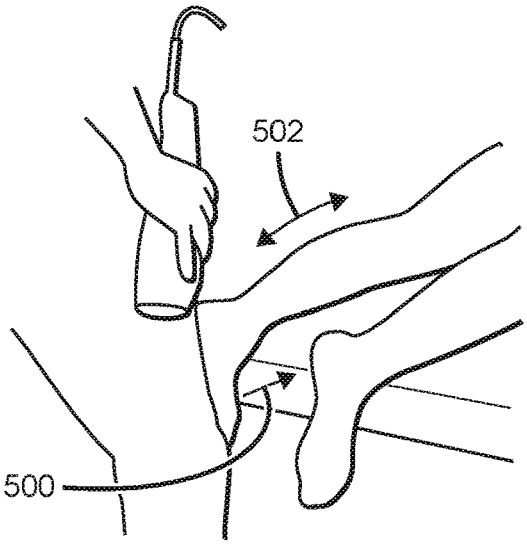
FIG. 5 shows an individual having their calf lengthened in an alternative manner.
Figure 6:
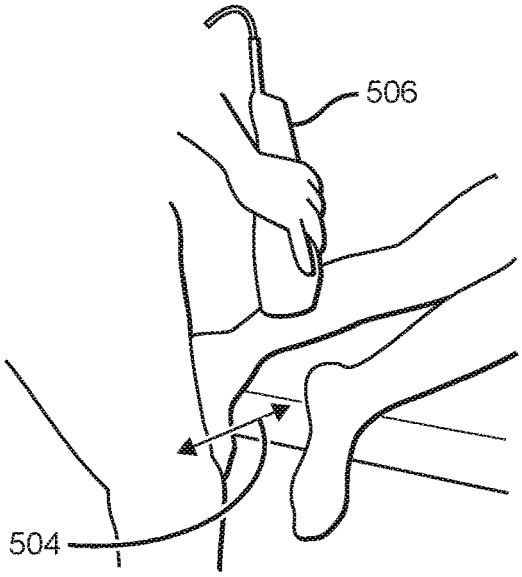
FIG. 6 shows vibration being applied to an individual's calf muscles while the lengthened calf muscles are oscillated.

Although FIGS. 2-4 show an individual stretching their calf muscles using a stretching cage (i.e., the calf muscles are the targeted area), it is contemplated that embodiments of the inventive subject matter can be applied to many different parts of the body, both with and without the assistance of a stretching cage. FIG. 5-6 show an alternative approach to treating an individual's lower leg. FIG. 5 shows how the individual's calf muscles can be lengthened by applying pressure to the bottom of the individual's foot (e.g., the pad of the foot) according to line 500. Double-arrowed line 502 shows that the individual's calf muscles are lengthened when pressure is applied to the bottom of the individual's foot.

Next, as shown in FIG. 6, the individual's calf muscles are oscillated according to line 504 and vibration is applied using a handheld vibration tool 506. The steps of oscillation and vibration are applied according to the description above, thereby improving, for example, flexibility in the individual's calf muscles. Lower extremity stretches should be performed bilaterally (e.g., on both sides of the body) to help prevent imbalances from developing, which can exacerbate symptoms or lead to new symptoms.

FIGS. 7-8 show an individual being treated for plantar fasciitis according to the inventive subject matter. First, the toes are manipulated to stretch the bottom of the foot in the lengthening step, as shown by line 700 in FIG. 7. The toes are pressed back toward the individual's shin to lengthen the plantar fascia before the toes are oscillated and vibration is applied to the plantar fascia (the targeted area). The individual's toes are oscillated according to double-arrowed line 702 while vibration is applied using a handheld vibration tool 704. Steps to treat plantar fasciitis are carried out according to descriptions presented above.

FIGS. 9-11 show an individual being treated according to the inventive subject matter with the targeted area being the individual's gluteal muscles. As shown in FIG. 9, the first step is to lengthen the targeted area. To do this, the individual is shown pulling their knee back toward their chest according to line 900. This lengthens the gluteus muscles (i.e., the targeted area) to a baseline length. Next, as shown in FIG. 10, the individual oscillates their leg according to double-arrowed line 702 to lengthen and relax the targeted area while vibration is applied by a handheld vibration tool 704.

In some embodiments, the lengthening step can be carried out using variations of stretches in between rounds of oscillation and vibration. FIG. 11, for example, shows an individual altering from a first gluteal stretch (shown in FIG. 9) to a second gluteal stretch that incorporates an out-stretched leg. Different stretches can affect different areas of a targeted area differently. For example, when a targeted area includes a plurality of muscles, different stretches can focus on different muscles within the targeted area. Thus, different stretches can be used in different rounds to place focus on different muscles in a target area to, for example, place focus on a muscle within a muscle group that has been strained or otherwise injured. When the individual has lengthened the targeted area again, the steps of oscillation and vibration can then be undertaken as shown in FIG. 11.

In some embodiments, methods of the inventive subject matter can be used to alleviate pain or improve range of motion. Active release techniques are intended to target areas in an individual's body where that individual has experienced restricted range of motion or where they have experienced pain. When used to alleviate pain, during the lengthening step, a target area is lengthened until the individual experiences restriction, pain, or both (e.g., an arm is moved until its movement is restricted by pain or discomfort in the shoulder joint). Next, the target area is oscillated in and out of the lengthened position, in some embodiments using an active assist device (e.g., pulleys, dowel, band, strap, etc.) while applying vibration to the targeted area.

This technique can be applied to several areas of the body, including targeted areas in the upper extremities and lower extremities. In one example, an individual is placed on their side, lying down, with their knees and hips flexed to 90 degrees FIG. 12. The practitioner then passively mobilizes the superior scapula 1200, thereby lengthening the targeted area (e.g., the region in which the individual is experiencing restricted movement and/or pain). Once lengthened, the individual's targeted area is oscillated and vibrated, according to embodiments of the method described in this application, to bring about desired results as shown in FIG. 13. Oscillation in this position involves moving the individual's shoulder in a circular motion to, e.g., lengthen several different muscles within the targeted area while vibration is applied. The number of rounds performed depends on how quickly the individual experiences improvements (e.g., increase range of motion, alleviated pain, etc.) in the targeted area. This is repeated with several oscillations (e.g., 10-30 oscillations) where the vibrating tool is pressed against the area of restriction or pain. In some embodiments, the practitioner alternates between counterclockwise and clockwise rotations. The same process is repeated with the individual then lying on their opposite side.

Figure 14:
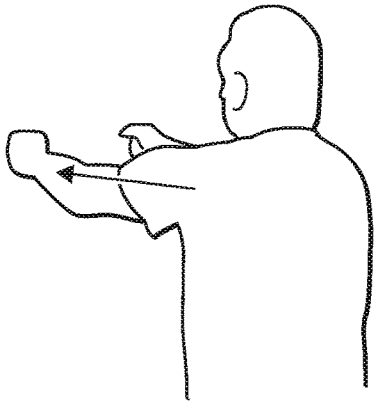
FIG. 14 shows an individual lengthening the muscles in the upper back.
Figure 16:
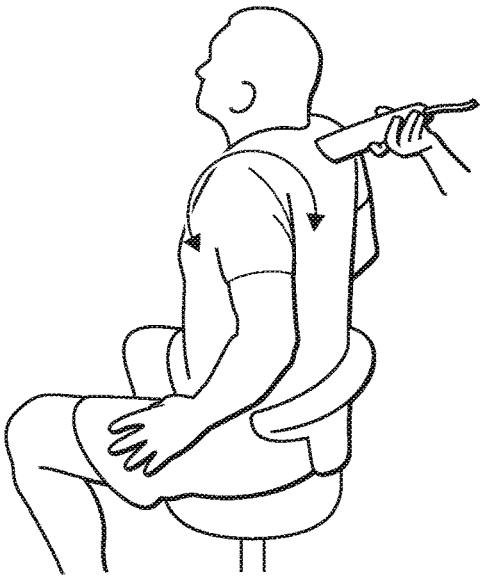
FIG. 16 shows an individual going through shoulder rotations while vibration is applied.
Figure 15:
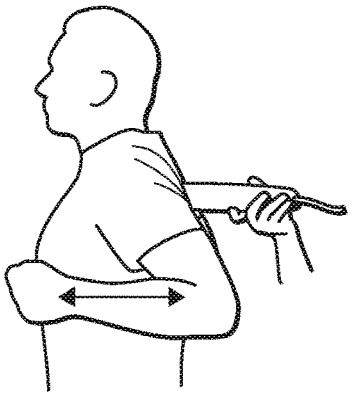
FIG. 15 shows an individual oscillating the muscles in the upper back while vibration is applied.

In another embodiment of the inventive subject matter, an individual is placed in a seated position (e.g., on a chair or the edge of a table) or standing position. In the lengthening step, the individual reaches both arms forward, introducing curvature to the upper back to lengthen the muscles in the upper back as shown in FIG. 14. Once lengthened, the individual then does a set of rows (e.g., 15-30, but preferably 20 repetitions), with their arms reaching forward and backward, bilaterally. While doing the rows, vibration is applied by a practitioner to the individual's middle thoracic region (e.g. a region of the upper back that is experiencing restricted range of motion and or pain), as shown in FIG. 15. In some embodiments, an individual is directed to perform a set of shoulder shrugs (e.g., 15-30, but preferably 20 repetitions) in counterclockwise and clockwise directions while the practitioner applies vibration to the individual's shoulder region (e.g. the superior shoulder region), as shown in FIG. 16. Although FIGS. 14 and 15 show the individual standing and FIG. 16 shows the individual sitting, it is contemplated that having the individual seated or standing can be a decision made based on how being seated or standing affects the lengthening step or based on the individual's symptoms (e.g., standing may be too challenging if an individual is in a lot of pain).

Figure 17:
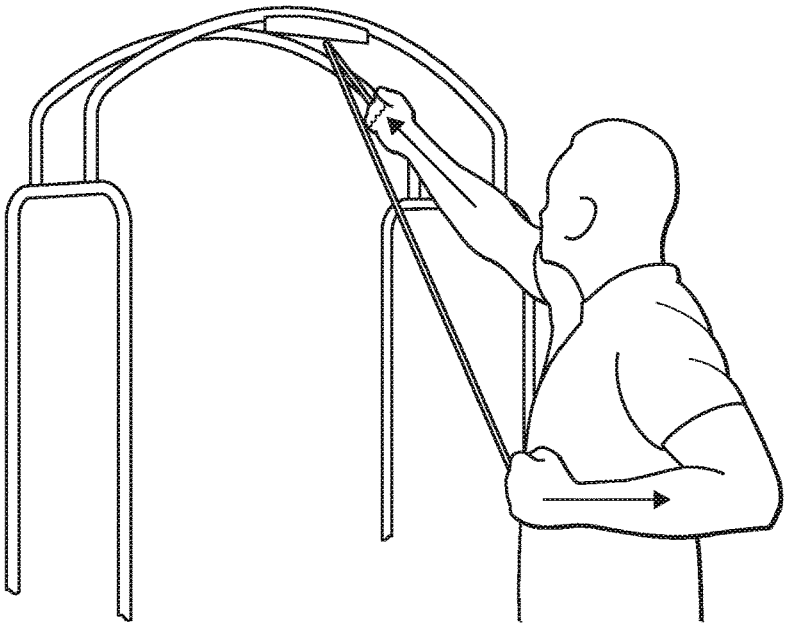
FIG. 17 shows an individual using a stretching cage with a pulley to lengthen the superior-lateral aspect of the individual's arm and thoracic region.

In another embodiment, an individual takes a position in a stretching cage using a pulley system that is anchored above the height of the individual's head. The individual is instructed to pull one arm down to elevate the opposite arm, thereby lengthening a targeted area, as shown in FIG. 17. Vibration is then applied to the superior-lateral aspect of the individual's arm and thoracic region while the individual oscillates in and out of that lengthened position as shown in FIG. 18.

Figure 18:
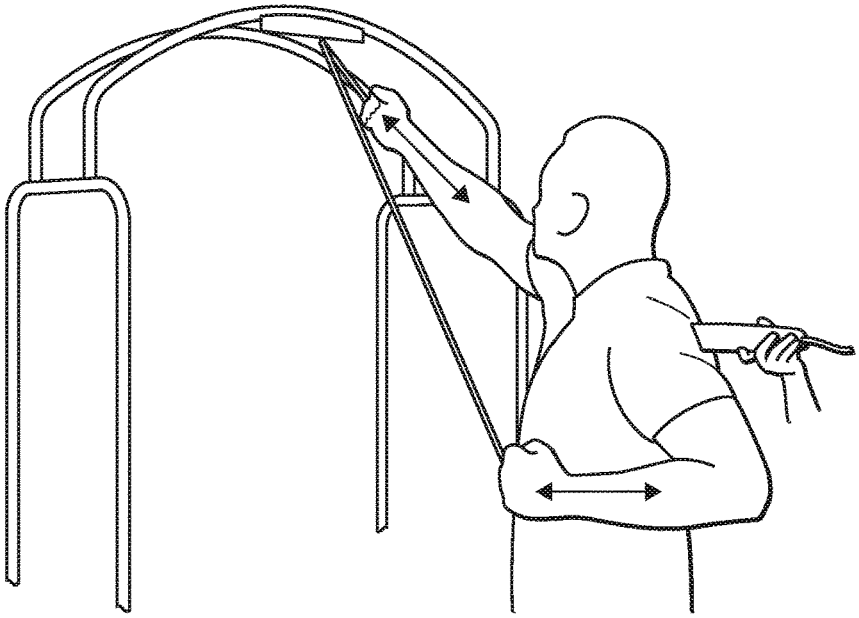
FIG. 18 shows and individual oscillating the superior-lateral aspect of the individual's arm and thoracic region while vibration is applied.

In another embodiment very similar to the one shown in FIGS. 17 and 18, a practitioner instructs an individual to take a position in a stretching cage so that they can pull one arm back as the opposite stretches forward creating a "bow-and-arrow" motion, using the pulley system shown in FIGS. 17 and 18. This position is a slight variation from the one shown in FIGS. 17 and 18 and is intended to lengthen different muscles groups in the individual's thoracic region. This can cause an individual with limited range of motion in the individual's thoracic region to experience discomfort. Vibration is then applied to the individual's entire thoracic region until the individual experiences improved symptoms. Sometimes, improvements will not be immediately felt, in which case the process must be repeated over some period (e.g., up to every day of a week for several weeks or months).

In some embodiments, systems and methods of the inventive subject matter can also be applied to an individual's lower extremities. Each of the following embodiments is meant to bring a different targeted area a position that causes the individual some level of discomfort related to restricted range of motion or muscle tightness.

Figure 19:
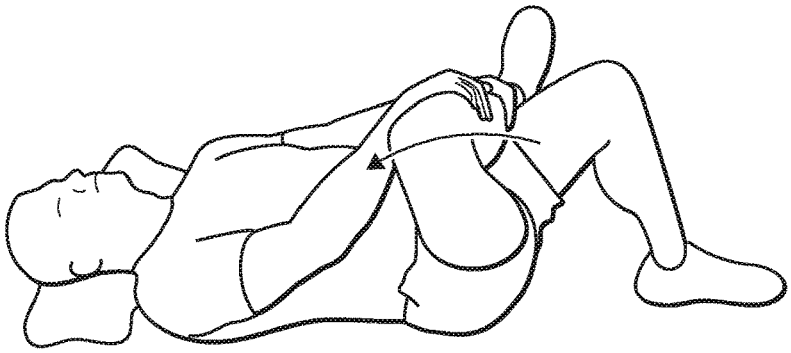
FIG. 19 shows an individual performing a supine piriformis stretch with the opposite leg flexed.
Figure 20:
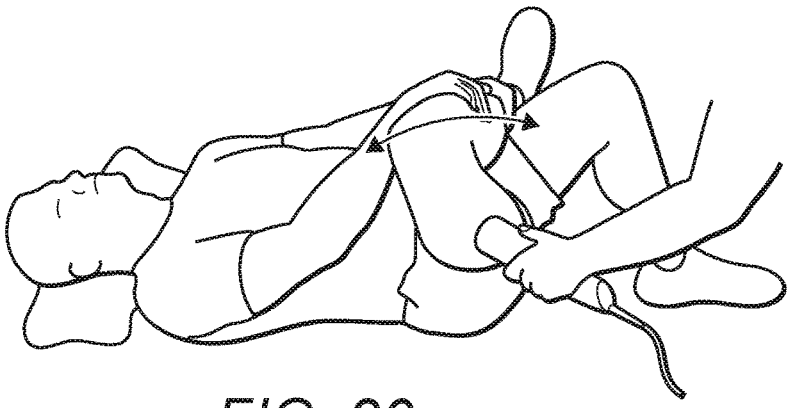
FIG. 20 shows an individual oscillating in an out of a supine piriformis stretch with the opposite leg flexed while vibration is applied.

For example, in one embodiment, the individual lies in a supine position on a treatment table, and performs (e.g., alone or with assistance from a practitioner or other device) the supine piriformis stretch with the opposite leg (e.g., the leg that is positioned under the other leg) flexed, as shown in FIG. 19. Once in this lengthened position, the individual oscillates in and out of that position while vibration is applied as shown in FIG. 20.

Figure 21:
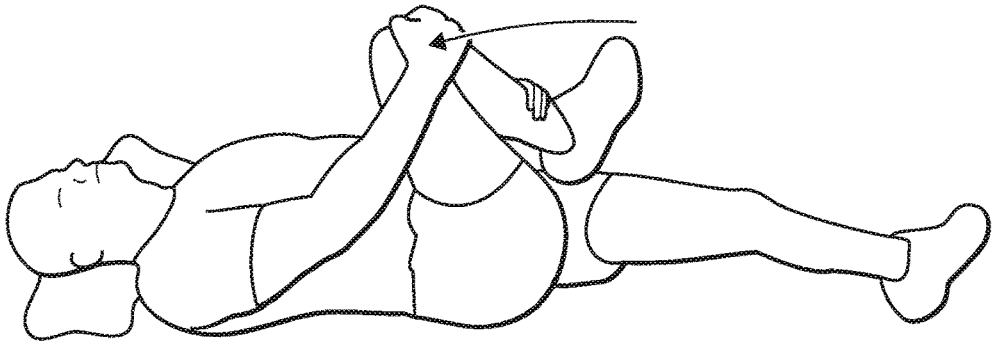
FIG. 21 shows an individual performing a supine piriformis stretch with the opposite leg flat.
Figure 22:
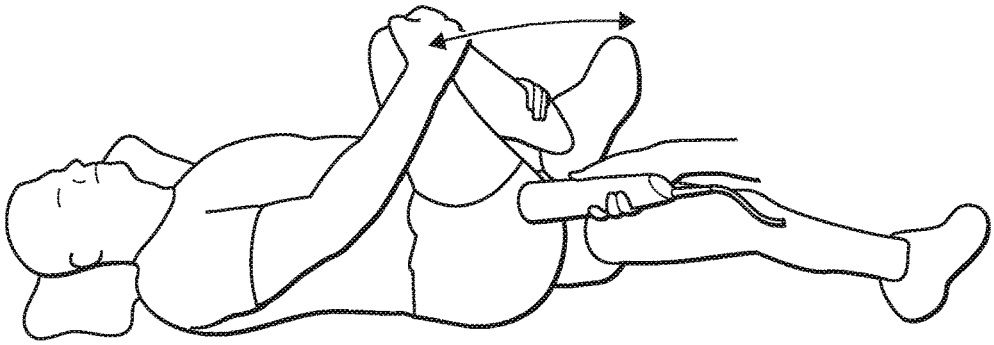
FIG. 22 shows an individual oscillating in an out of a supine piriformis stretch with the opposite leg flat while vibration is applied.

In another embodiment, an individual is instructed to perform a supine piriformis stretch with the opposite leg flexed, as shown in FIG. 21. Next vibration is applied to a targeted area while the individual oscillates in and out of the lengthened position, as shown in FIG. 22. In another embodiment of the same stretch, the individual is instructed to perform the supine piriformis stretch with opposite leg flat, very similar to the stretch shown in FIG. 21. Again, vibration is applied to a targeted area while the individual oscillates in and out of the lengthened position, just as is shown in FIG. 22. In each of these positions, methods of the inventive subject matter are applied to the targeted area corresponding to some amount of, e.g., discomfort experienced by the individual due to excessive tightness or restricted range of motion.

Figure 23:
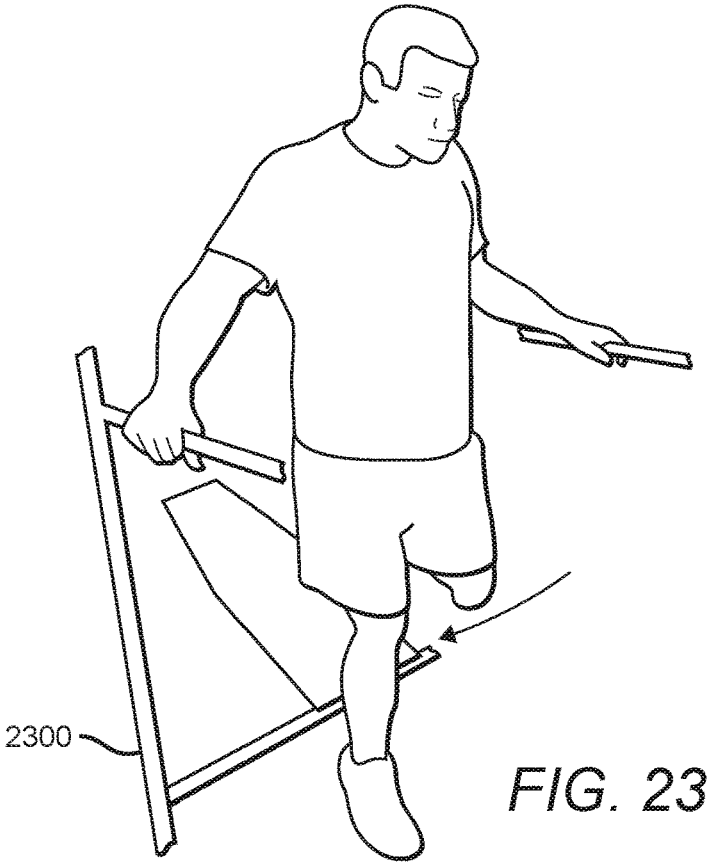
FIG. 23 shows an individual performing a standing quadricep stretch in a stretching cage.
Figure 24:
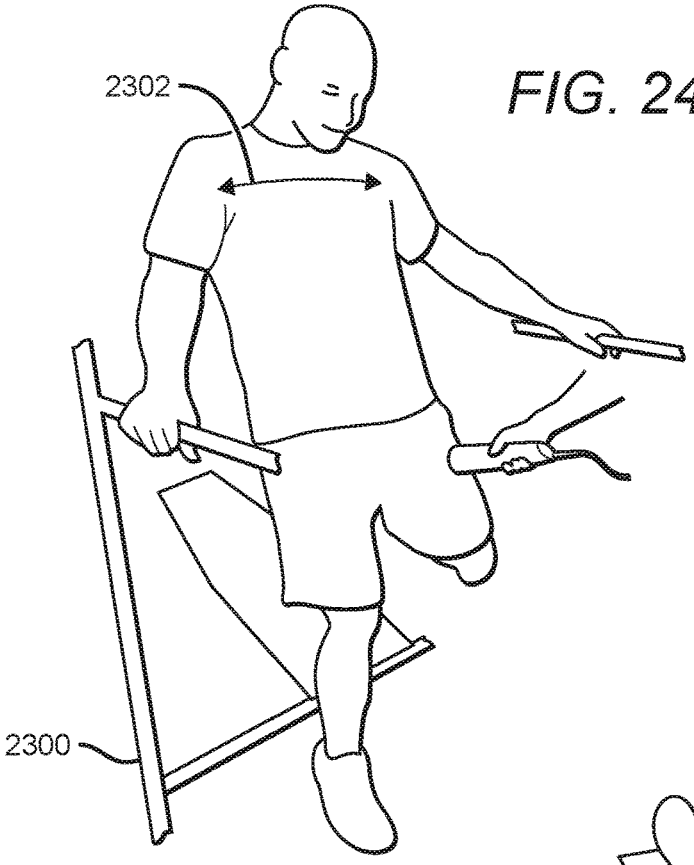
FIG. 24 shows an individual oscillating in a standing quadricep stretch in a stretching cage while vibration is applied.
Figure 25:
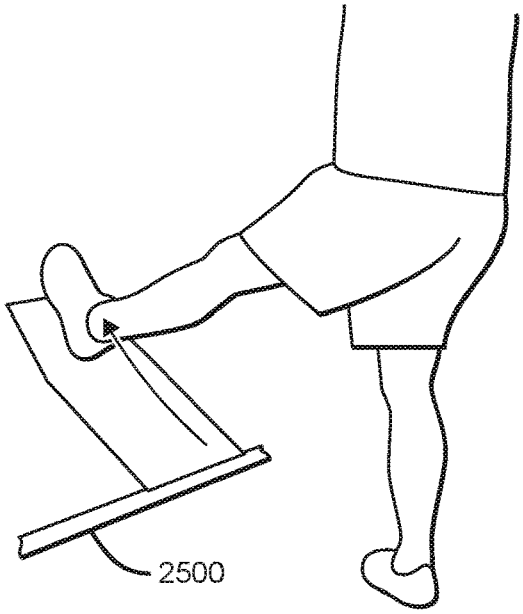
FIG. 25 shows an individual performing a hamstring stretch with the lower extremity propped up on an elevated surface.
Figure 26:
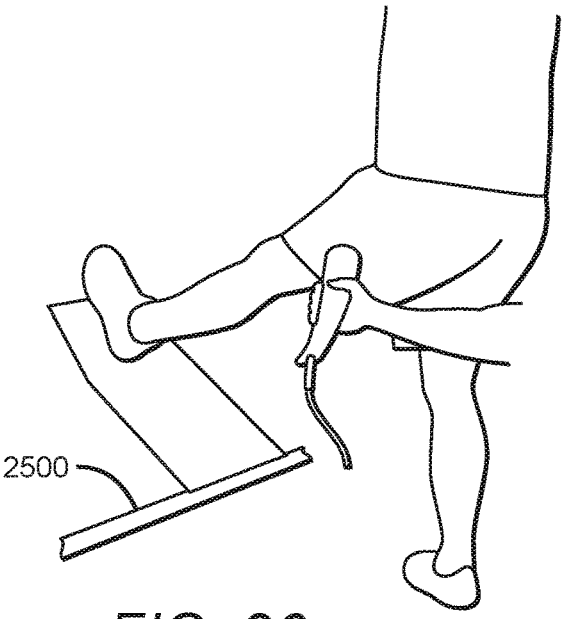
FIG. 26 shows an individual oscillating a hamstring stretch with the lower extremity propped up on an elevated surface while vibration is applied.

In another embodiment, a practitioner instructs the individual to perform a standing quadriceps stretch, e.g., within a stretching cage 2400, using the stretching cage to maintain balance and, in some embodiments, using the stretching cage 2400 to modify the stretch (e.g., to increase or reduce the lengthening of the targeted area by having the individual stand on a sloped portion of the stretching cage). This position is shown in FIG. 23. Next, vibration is applied to the targeted area (e.g., the quadriceps) while the individual oscillates in and out of the lengthened position, as shown in FIG. 24. To oscillate in and out of the stretch when the individual has their foot resting against a stationary portion of the stretching cage 2400, the individual can lean their upper body into and out of the stretch as demonstrated by double arrowed line 2402. In another embodiment, an individual lengthens their hamstrings by doing a standing hamstring stretch with the lower extremity propped up on an elevated surface (e.g., on a surface of a stretching cage), as shown in FIG. 25, and then vibration is applied to the targeted area while the individual oscillates in and out of the lengthened position (e.g., the hamstrings), as shown in FIG. 26. As with quadricep oscillation, the individual can lean their upper body into and out of the stretch to oscillation the hamstrings as shown in FIG. 26 by the double-sided arrow. The stretching cage 2600 in this embodiment can make it easier for certain individuals (e.g., the injured, the elderly, etc.) to maintain balance comfortably while holding their hamstring in the lengthened position.

In another embodiment, an individual performs a gluteal stretch using an elevated surface (e.g. on a surface of a stretching cage) with the involved hip externally rotated to lengthen the gluteal muscles, as shown in FIG. 27. Next, the individual oscillates in and out of that stretch while vibration is applied to the targeted area (e.g., the gluteal muscles), as shown in FIG. 28. In another embodiment, a practitioner instructs the individual to perform a standing gastrocnemius/soleus stretch (e.g., with the assistance of a stretching cage) to lengthen those muscle groups, as shown in FIG. 29. Next, vibration is applied to the targeted area (e.g., the gastrocnemius/soleus muscles) while the individual oscillates in and out of the lengthened position, as shown in FIG. 30.

In some embodiments, methods of the inventive subject matter can be applied to various joints to improve an individual's range of motion and/or alleviate pain. This can be especially useful in individuals that are unable to participate in activities or sports that they otherwise would enjoy.

To improve the range of motion and/or alleviate pain in an individual's knee, an individual is instructed to perform a standing quadriceps/hip flexor stretch (e.g., with the assistance of a stretching cage) to lengthen muscles, ligaments, and tendons in and associated with the knee, similar to the stretch shown in FIG. 23. Next, the individual's knee is oscillated medially, laterally, or both while vibration is applied. Vibration can be applied to the anterior aspect of the entire thigh superior to patella and inferior to the inguinal region.

To improve the range of motion and/or alleviate pain in an individual's hip, the individual is instructed to perform a one of several piriformis/gluteal stretches in a supine or long sitting position, similar to the stretches shown in FIGS. 19, 21, and 27. Next, vibration is applied to the targeted area (e.g., piriformis/gluteal muscles) while the individual oscillates in and out of the stretches as shown in FIGS. 20, 22, and 28.

To improve the range of motion and/or alleviate pain in an individual's lumbar spine, the individual is instructed to perform a gluteal stretch (e.g., using a surface of the stretching cage or a table) with their hip externally rotated, as shown in, e.g., FIG. 27. The individual's opposite foot is placed on the floor and progressively slides back away from target leg to lengthen the targeted area. Vibration is then applied to the targeted area (e.g., the posterior-lateral aspect of the individual's gluteal region) while the individual oscillates in and out of the lengthened position.

To improve the range of motion and/or alleviate pain in an individual's thoracic spine, the individual is instructed to lengthen a targeted area by moving into a position related to standing rows, as shown in, e.g., FIG. 14. The individual then oscillates by performing standing rows with exaggerated forward and backward movements while vibration is applied to the targeted area (e.g., the individual's mid/para scapular region), as shown in FIG. 15.

To improve the range of motion and/or alleviate pain in an individual's forearm, the individual's humerus is moved into a position of full extension with the forearm internally rotated and the wrist flexed. The individual then repeats the motion (e.g. oscillates) in and out of the stretch vibration is applied to the entire forearm. The same process can be repeated on the individual's opposite arm and forearm.

To improve the range of motion and/or alleviate pain in an individual's shoulder (e.g., scapula), the individual lengthens a targeted area (e.g., the muscles, ligaments, and tendons around and associated with the scapula) with the assistance of a pulley that is coupled with, e.g., a stretching cage or anchored in a door, as shown in FIG. 17. Next, vibration is applied to the targeted area while the individual oscillates in and out of that lengthened position by reaching to the highest point on one arm and lowest on the opposite arm, as shown in FIG. 18.

To improve the range of motion and/or alleviate pain in an individual's cervical spine, the individual performs shoulder shrugs in a circular direction (e.g., up/back/down), while a practitioner applies vibration to the individual's upper trapezius musculature, or to a region of the individual's body where the individual reports pain or discomfort.

To alleviate pain associated with temporomandibular joint dysfunction (TMJ), the individual is instructed to open their mouth to lengthen the targeted area (e.g., the jaw muscles), as shown in FIG. 31. Vibration is then applied to the targeted area while the individual opens and closes their mouth, as shown in FIG. 32.

As shown in FIGS. 33A and 33B, a handheld vibration tool 3300 that can be used with embodiments of the inventive subject matter can include one or more surfaces 3302, 3304, 3306, & 3308 with which vibration can be applied to a targeted area. For example, the handheld vibration tool 3300 can have a first surface 3302 that is larger and flatter that the other surfaces. The handheld vibration tool 3300 can also include several other surfaces 3304, 3306, & 3308 that can have different sizes and shapes from the first surface 3302. Each surface can have a rubber or rubber-like surface that improves the ability of the handheld vibration tool 3300 to apply vibration to a targeted area (e.g., in some embodiments a surface that provides increased friction between the surface and an individual's skin and in other embodiments a surface that provides reduced friction between the surface and an individual's skin). The rubber portion of each surface can differ between surfaces. For example, surface 3304 has a smaller rubber portion than 3306. This configuration allows the rubber portion of surface 3306 to affect vibration (e.g., by damping the vibration or enhancing the vibration, depending on the surface material). Surface 3308 comprises a convex shape that can allow for the application of vibration to a smaller, more targeted area that might otherwise be difficult to reach using the other surfaces.

Each of these additional surfaces can apply different types of vibration based on how they are coupled with the first surface. The handheld vibration tool can cause the first surface to move in and out according to double-arrowed line 3316, side to side according to double-sided lines 3310 & 3312, in a circular motion according to double-arrowed line 3314, or any combination thereof. Because each additional vibration surface 3304, 3306, & 3308 is coupled with the first surface 3302, those additional vibration surfaces 3304, 3306, & 3308 therefor vibrates according to vibration of the first surface by virtue of how those additional surfaces are coupled with the first surface.

Thus, specific compositions and methods of treating individuals with paint and reduced range of motion have been disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A method of improving symptoms in an individual's body, comprising:

using a stretching cage to facilitate lengthening a targeted area of an individual until the individual is in a lengthened position;

wherein the targeted area comprises at least one muscle and wherein the lengthened position is one in which the individual experiences a stretching sensation in the targeted area;

manipulating the individual, in an oscillatory manner, in and out of the lengthened position; and while manipulating the individual, applying vibration to the targeted area using a handheld vibration tool.

2. The method of claim 1, wherein the stretching cage further comprises a pulley that is affixed to the stretching cage, wherein the individual uses the pulley to facilitate lengthening of the targeted area.

3. The method of claim 1, wherein the step of manipulating the individual in and out of the lengthened position comprises oscillating in and out of the lengthened position 10-30 times.

4. The method of claim 1, wherein the handheld vibration tool vibrates between 100-300 Hz.

5. The method of claim 1, wherein the handheld vibration tool vibrates with an amplitude between 0.5-7 mm.

6. The method of claim 1, wherein the preceding steps are repeated 1-6 times.

7. The method of claim 1, wherein the steps of manipulating and applying vibration are undertaken for 10-45 seconds.

* * * * *